US006120958A

United States Patent [19]

Ookubo et al.

[11] Patent Number: 6,120,958

[45] Date of Patent: Sep. 19, 2000

[54] ELECTROSTATIC IMAGE DEVELOPING TONER

[75] Inventors: Masaki Ookubo; Hiroshi Nanaumi; Kaoru Kasahara, all of Kooriyama, Japan

[73] Assignee: Hodogaya Chemical Co., Ltd., Kawasaki, Japan

[21] Appl. No.: 09/363,647

[22] Filed: Jul. 30, 1999

[30] Foreign Application Priority Data

Jul. 31, 1998 [JP] Japan ..... 10-229466

[51] Int. Cl.[7] ..... G03G 9/09

[52] U.S. Cl. ..... 430/106; 430/111

[58] Field of Search ..... 430/106, 111

[56] References Cited

U.S. PATENT DOCUMENTS

| | | | |
|---|---|---|---|
| 4,623,606 | 11/1986 | Ciccarelli | 430/110 |
| 4,624,907 | 11/1986 | Niimura et al. | 430/110 |
| 4,857,432 | 8/1989 | Tanikawa et al. | 430/110 |
| 5,439,770 | 8/1995 | Taya et al. | 430/106 |
| 5,770,341 | 6/1998 | Mukudai et al. | 430/110 |
| 5,856,055 | 1/1999 | Ugai et al. | 430/106 |

*Primary Examiner*—Roland Martin
*Attorney, Agent, or Firm*—Oblon, Spivak, McClelland, Maier & Neustadt, P.C.

[57] ABSTRACT

An electrostatic image developing toner comprising an azo type iron complex having a volume average particle size within a range of from 6 to 15 $\mu$m and represented by the formula (A):

(A)

wherein Ar is an aryl group or a substituted aryl group, each of X1, X2, Y1 and Y2 is —S—, —O—, —CO—, —NH— or —NR— wherein R is a $C_{1-4}$ alkyl group, and Z is a cation as a counter ion.

6 Claims, No Drawings

ELECTROSTATIC IMAGE DEVELOPING TONER

The present invention relates to an electrostatic image developing toner containing a charge-control agent.

Developing methods applicable to electrophotography, etc., are generally classified into a dry developing method and a wet developing method. The dry developing method may further be divided into a method of employing a two component developer and a method of employing a single component developer.

As a toner to be used for such developing methods, it has been common to employ a fine powder having a dye or a pigment dispersed in a natural or synthetic resin. For example, one having a colorant dispersed in a binder resin of e.g. polystyrene, is finely pulverized to particles of from about 1 to 30 μm, which are used as a toner. Further, as a magnetic toner, one containing magnetic particles such as magnetite particles, is employed.

Any one of such toners is required to have a positive or negative charge depending upon the polarity of an electrostatic latent image to be developed. To electrify the toner, the tribocharge property of a resin as a component of the toner can be utilized, but by such a method, the electrification of the toner is low, whereby an image obtainable by development tends to be fogging or unclear. Therefore, in order to impart a desired tribocharge property to the toner, it has been common to incorporate a dye or a pigment capable of imparting an electrifiable property, or a charge-control agent.

A toner containing a charge-control agent is likely to soil a toner carrier such as a developing sleeve, whereby the tribocharge tends to decrease as the number of copying sheets increases, thus leading to a decrease in the image density. Further, a charge-control agent of a certain type provides inadequate tribocharge and is susceptible to an influence of the temperature or humidity, thus leading to a change in the image density due to a change of the environment. Further, a charge-control agent of a certain type is so poor in the dispersibility in a resin that a toner employing it tends to have non-uniformity in the tribocharge among toner particles, whereby fogging is likely to result. Further, a charge-control agent of a certain type is poor in the storage stability, whereby the tribocharge tends to decrease during the storage for an extended period of time.

As a means to solve such problems, JP-A-61-155464 proposes an iron complex. This publication discloses that the iron complex has a negative tribocharge property and shows an excellent compatibility with a resin, and at the same time, by the nature of an iron complex, it is excellent also from the viewpoint of the environmental safety, as is different from a conventional chromium compound as disclosed in JP-A-55-42752.

In recent years, printers or facsimile machines employing electrophotography have been widely used, and the copying speed has been increased year after year, whereby a toner electrifiable to a proper level instantaneously as compared with conventional copying machines, has been required. Namely, at present, it is required, more than the conventional toners, that the toner will have a proper level of electrification instantaneously when brought into a switched on state from a switched off state, and the tribocharge performance will not deteriorate even when it is left to stand for a long period of time. This requirement is applicable also to the toner containing an iron complex as disclosed in JP-A-61-155464.

It is an object of the present invention to provide an electrostatic image developing toner which can be electrified to a proper level instantaneously, whereby the tribocharge performance will not deteriorate even when it is left to stand for a long period of time, by employing a compound which contains no chromium as a coordinated center metal in view of the environmental safety.

The present invention provides (1) an electrostatic image developing toner comprising an azo type iron complex having a volume average particle size within a range of from 6 to 15 μm and represented by the formula (A):

(A)

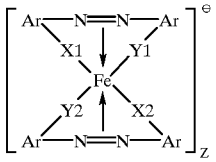

wherein Ar is an aryl group or a substituted aryl group, each of X1, X2, Y1 and Y2 is —S—, —O—, —CO—, —NH— or —NR— wherein R is a $C_{1-4}$ alkyl group, and Z is a cation as a counter ion.

Further, the present invention provides (2) an electrostatic image developing toner comprising an azo type iron complex having a volume average particle size within a range of from 6 to 15 μm and represented by the formula (B):

(B)

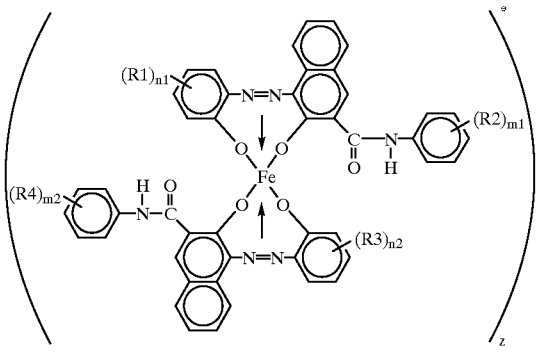

wherein each of R2 and R4 which may be the same or different from each other, is a hydrogen atom, a lower alkyl group, a lower alkoxy group, a nitro group or a halogen atom, each of m1 and m2 is an integer of from 1 to 5, each of R1 and R3 which may be the same or different from each other, is a hydrogen atom, a $C_{1-18}$ alkyl group, an alkenyl group, a sulfonamide group, a mesyl group, a sulfonic group, a carboxyl group, a carboxyester group, a hydroxyl group, a $C_{1-18}$ alkoxy group, an acetylamino group, a benzoylamino group, a nitro group or a halogen atom, each of n1 and n2 is an integer of from 1 to 4, and Z is a cation as a counter ion.

The present invention also provides (3) the electrostatic image developing toner according to item (1), wherein the azo type iron complex has a volume average particle size within a range of from 8 to 13 μm.

The present invention also provides (4) the electrostatic image developing toner according to item (2), wherein the azo type iron complex has a volume average particle size within a range of from 8 to 13 μm.

Further, the present invention provides (5) an electrostatic image developing toner comprising an azo type iron complex having a volume average particle size within a range of from 6 to 15 μm and represented by the formula (C):

(C)

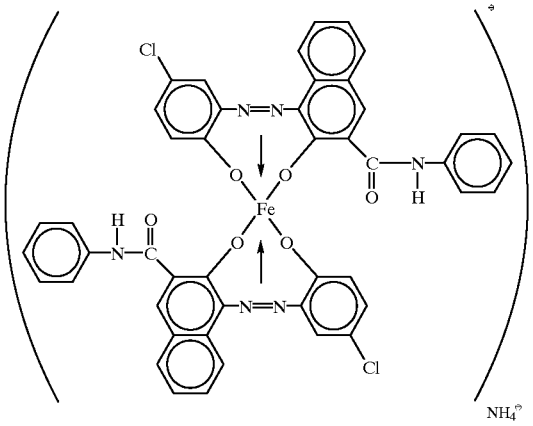

Still further, the present invention provides the electrostatic image developing toner according to item (5), wherein the azo type iron complex has a volume average particle size within a range of from 8 to 13 μm.

As a result of a study by the present inventors, it has been found that as compared with a conventional toner containing an azo type iron complex having a volume average particle size of at most 3 μm, a toner containing an azo type iron complex having a volume average particle size within a range of from 6 to 15 μm, preferably from 8 to 13 μm, in its particle size distribution, can instantaneously be electrified to a proper level, and its tribocharge performance will not deteriorate even when it is left to stand for a long period of time. The present invention has been accomplished on the basis of this discovery.

Now, the present invention will be described in detail with reference to the preferred embodiments.

Specific examples of the azo type iron complex will be given below.

(C)

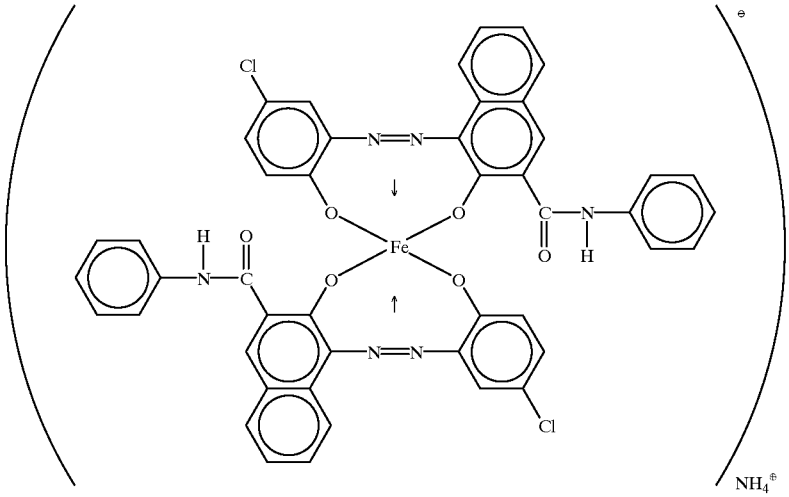

(D)

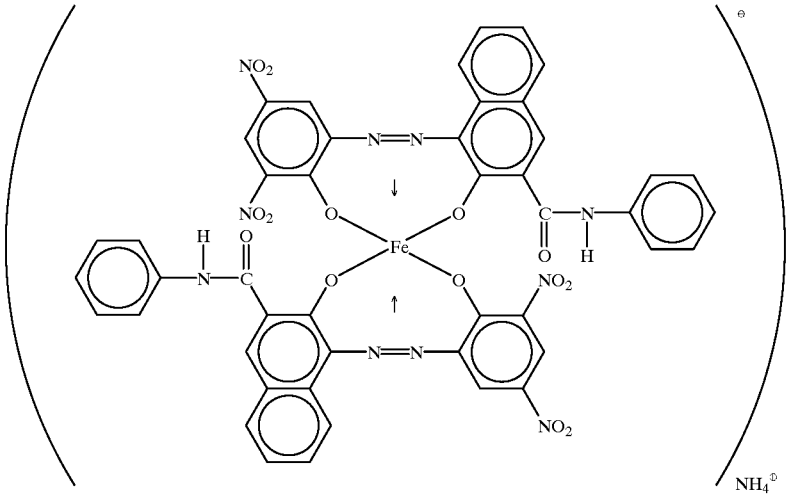

-continued
(E)
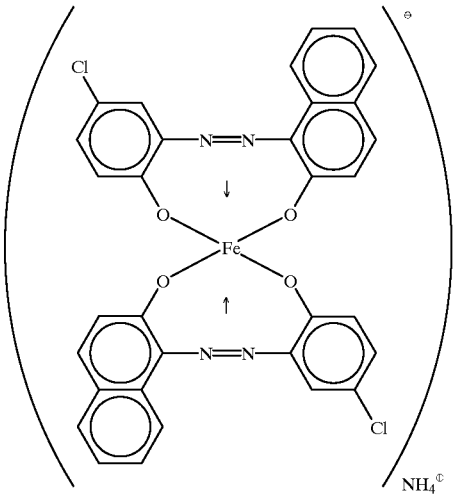
(F)
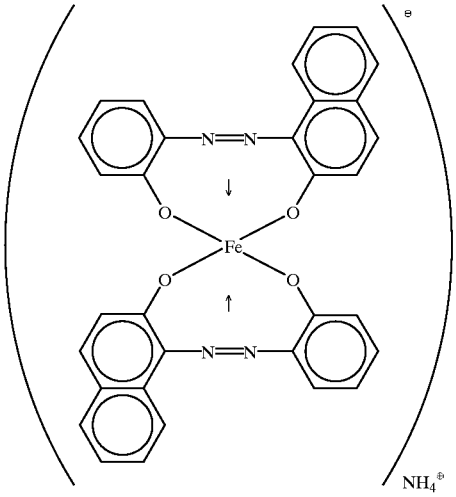
(G)
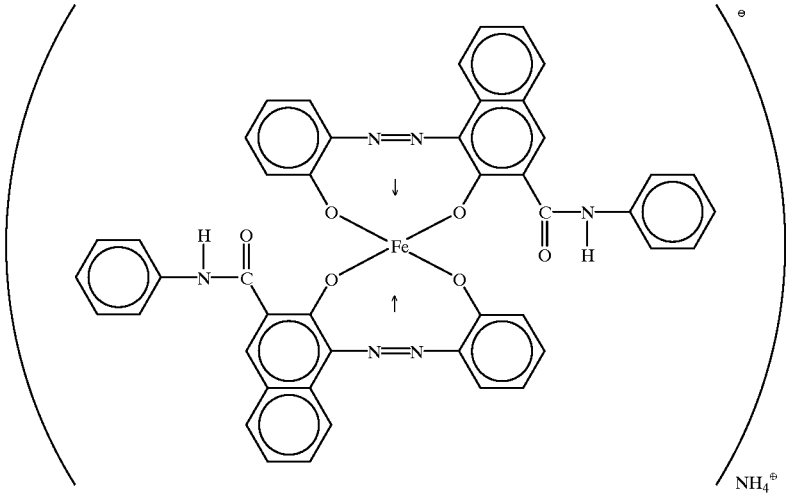

-continued
(H)
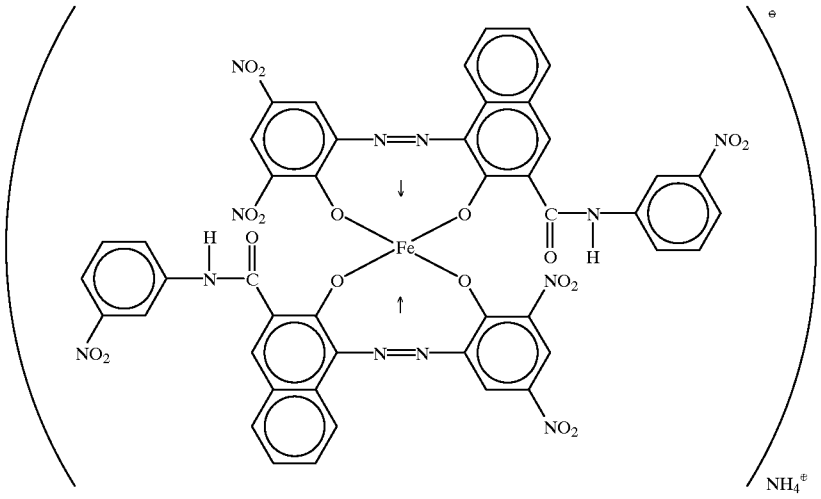
(I)
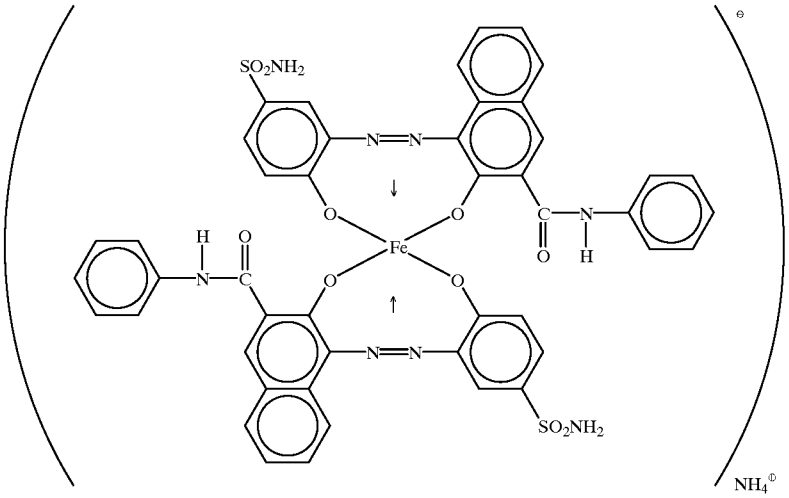
(J)
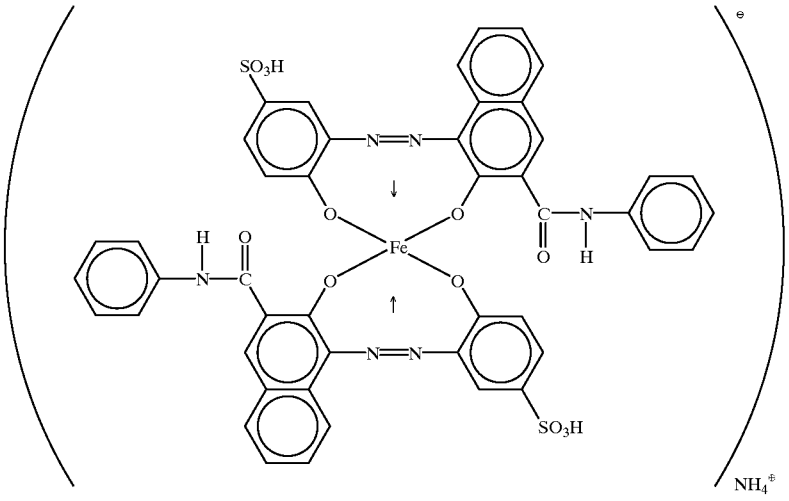

-continued (K)

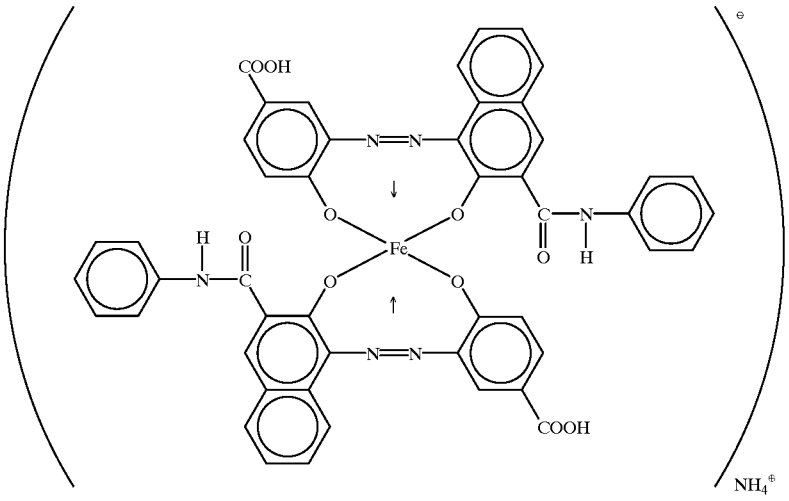

As a method for producing the above azo type iron complex, an example may be mentioned such that an amine such as 4-chloro-2-aminophenol, 4-sulfoamide-2-aminophenol, 4-bromo-2-aminophenol, 4-sulfomethyl-2-aminophenol or 4-sulfoethyl-2-aminophenol, is diazotized and then subjected to coupling with β naphthol or naphthol AS to obtain a monoazo compound, which is then converted to an iron complex by a known method, for example, by dissolving the monoazo compound in ethylene glycol and adding sodium hydroxide and ferric chloride thereto. If the obtained sodium iron complex is treated with e.g. acetic acid, the counter ion will be a hydrogen ion.

Otherwise, if it is treated with aqueous ammonia or an inorganic ammonium salt, an ammonium salt will be obtained. As such an inorganic ammonium salt to be used, ammonium nitrate, ammonium carbonate or ammonium sulfate, may, for example, be mentioned.

The compound thus obtainable will have a particle size distribution of from 10 to 100 μm and has, by itself, a poor function as a charge-control agent. As a method for adjusting the above compound to have a volume average particle size within a range of from 6 to 15 μm, a method of physically pulverizing it in a sand grinder mill, followed by classification, or as another method, a chemical method of dissolving it in an organic solvent, followed by recrystallization, may, for example, be mentioned.

As a method for incorporating the azo type iron complex to the toner, a method of adding it into the interior of the toner particles, or a method of adding it to the exterior of the toner particles, is available. Such an azo type iron complex is used usually in an amount within a range of from 0.01 to 20 parts by weight, preferably from 0.1 to 10 parts by weight, more preferably from 0.5 to 5 parts by weight, per 100 parts by weight of a binder resin, although the amount is determined depending upon the type of the binder resin, the presence or absence of an additive to be used as the case requires, or the method for producing the toner including a method for dispersion and can not generally be defined.

The azo type iron complexes of the present invention may be used in combination with charge-control agents of different types.

When a non-magnetic toner of the present invention is used in admixture with a carrier as a two component developer, a conventional carrier may be employed. For example, a magnetic powder such as an iron powder, a ferrite powder or a nickel powder, glass beads, or one having their surface treated with e.g. a resin, may be mentioned. As the resin for coating the carrier surface, a styrene-acrylate copolymer, a styrene-methacrylate copolymer, an acrylate copolymer, a methacrylate copolymer, a silicon resin, a fluorine-containing resin, a polyamide resin, an ionomer resin, a polyphenylene sulfide resin, or a mixture thereof, may be employed.

The non-magnetic toner of the present invention is used preferably by adding an inorganic oxide fine powder to the toner particles. As such an inorganic oxide fine powder, a fine silica powder, a fine titanium oxide powder, a fine aluminum oxide powder, a fine cerium oxide powder or a fine strontium titanate powder, may, for example, be employed. Further, one having such an inorganic oxide fine powder surface-treated with e.g. a silane coupling agent or a silicone oil for hydrophobic treatment, may also be used. The amount of such an inorganic fine powder is preferably from 0.05 to 5 parts by weight, per 100 parts by weight of the non-magnetic toner.

Further, the toner of the present invention can be used as a magnetic toner containing a magnetic material (single component developer). In such a case, the magnetic material plays a role also as a coloring agent. The magnetic material contained in the magnetic toner of the present invention, may, for example, be an iron oxide such as magnetite, hematite or ferrite, a metal such as iron, cobalt or nickel, or an alloy of such a metal with a metal such as aluminum, cobalt, copper, lead, magnesium, tin, zinc, antimony, beryllium, bismuth, cadmium, calcium, manganese, selenium, titanium, tungsten or vanadium, or a mixture thereof. Such a ferromagnetic material preferably has an average particle size of from 0.1 to 2 μm, more preferably from 0.1 to 0.5 μm, and the amount contained in the toner, is usually from about 20 to 100 parts by weight, per 100 parts by weight of the resin component.

The toner of the present invention can be used as a toner for a single component developing system or a two component developing system, and it is also useful for a method wherein a carrier is further added to the magnetic toner containing a magnetic material.

As the coloring agent useful for the toner of the present invention, an optional suitable pigment or dye may be mentioned. For example, the pigment may be carbon black, aniline black, acetylene black, naphthol yellow, hanza yellow, rhodamine lake, alizarin lake, iron oxide red, phthalocyanine blue or indanthrene blue. The amount is usually from 0.1 to 20 parts by weight, per 100 parts by weight of the resin. The dye may, for example, be an azo dye, an anthraquinone dye, a xanthene dye or a methine dye, and the amount is usually from 0.1 to 20 parts by weight, per 100 parts by weight of the resin.

The binder resin to be used in the present invention, may, for example, be a homopolymer of styrene or its substituted compound, such as a polystyrene, a poly-p-chlorostyrene or a polyvinyl toluene; a styrene copolymer, such as a styrene-p-chlorostyrene copolymer, a styrene-vinyl toluene copolymer, a styrene-vinyl naphthalene copolymer, a styrene-acrylate copolymer, a styrene-methacrylate copolymer, a styrene-methyl α-chloromethacrylate copolymer, a styrene-acrylonitrile copolymer, a styrene-vinyl methyl ether copolymer, a styrene-vinyl ethyl ether copolymer, a styrene-vinyl methyl ketone copolymer, a styrene-butadiene copolymer, a styrene-isoprene copolymer or a styrene-acrylonitrileindene copolymer; a polyvinyl chloride, a phenol resin, a natural modified-phenol resin, a natural resin-modified maleic acid resin, an acryl resin, a methacryl resin, a polyvinyl acetate, a silicone resin, a polyester resin, a polyurethane resin, a polyamide resin, a furan resin, an epoxy resin, a xylene resin, a polyvinyl butyral resin, a terpene resin, a cumaroindene resin, or a petroleum resin.

A crosslinked styrene copolymer may also be used as a binder resin.

A comonomer to a styrene monomer of the styrene copolymer, may, for example, be a monocarboxylic acid having a double bond or its substituted compound, such as acrylic acid, methyl acrylate, ethyl acrylate, butyl acrylate, dodecyl acrylate, octyl acrylate, 2-ethylhexyl acrylate, phenyl acrylate, methacrylic acid, methyl methacrylate, ethyl methacrylate, octyl methacrylate, acrylonitrile or acrylamide, a dicarboxylic acid having a double bond or its substituted compound, such as maleic acid, butyl maleate, methyl maleate or dimethyl maleate, a vinyl ester such as vinyl chloride, vinyl acetate or vinyl benzoate, an ethylenic olefin such as ethylene, propylene or butylene, a vinyl ketone such as vinyl methyl ketone or vinyl hexyl ketone, or a vinyl ether such as vinyl methyl ether, vinyl ethyl ether or vinyl isobutyl ether. These comonomers may be used alone or in combination as a mixture of two or more of them.

Here, the crosslinking agent may be a compound having at least two polymerizable double bonds. For example, an aromatic divinyl compound such as divinyl benzene or divinyl naphthalene; a carboxylate having two double bonds such as ethylene glycol diacrylate, ethylene glycol dimethacrylate or 1,3-butanediol dimethacrylate; a divinyl compound such as divinyl aniline, divinyl ether, divinyl sulfide or divinyl sulfone; and a compound having at least three vinyl groups, may be used alone or in combination as a mixture.

Further, as the polyester resin, a polyester resin obtainable by reacting a polycarboxylic acid with an etherified bisphenol, may be mentioned.

The dibasic aromatic carboxylic acid as the carboxylic acid to be used for the polyester may, for example, be phthalic acid, isophthalic acid, phthalic anhydride, terephthalic acid or a derivative such as an ester thereof. The tribasic or higher basic aromatic polycarboxylic acid may, for example, be 1,2,4-benzene tricarboxylic acid, 1,2,5-benzene tricarboxylic acid, 1,2,4-naphthalene tricarboxylic acid, 2,5,7-naphthalene tricarboxylic acid, 1,2,4,5-benzene tetracarboxylic acid, or an anhydride or esterified product thereof. The amount of the tribasic or higher basic aromatic polycarboxylic acid is preferably not exceeding 40 mol % in the acid components.

Further, the dibasic aliphatic carboxylic acid may, for example, be maleic acid, fumaric acid, succinic acid, adipic acid, sebatic acid or itaconic acid. Other acid components may also be used within a range not to impair the object of the present invention. The etherified bisphenol to be used in the present invention is mainly an etherified bisphenol obtained by etherifying bisphenol, particularly a propoxy-modified and/or ethoxy-modified bisphenol. Such a compound has from 2 to 3 mols of oxypropylene or oxyethylene per mol of bisphenol. Specific examples include polyoxypropylene-2,2-bis(4-hydroxyphenyl)propane, polyoxypropylene-2,2-bis(4-hydroxy-2,6-dichlorophenyl) propane and polyoxyethylene-(1.0-polyoxypropylene(1.5)-bis(4-hydroxyphenyl)propane.

The above etherified bisphenol can be obtained, for example, by directly adding ethylene oxide or propylene oxide to bisphenol, or by reacting bisphenol with an olefin haloidline. The acid value of the polyester to be used, is preferably from 10 to 50.

As an alcohol component as other starting material for the polyester resin, an aliphatic polyol such as ethylene glycol, propylene glycol, 1,4-butanediol, 1,5-pentanediol, 1,6-hexenediol, glyceol, trimethylol ethane, trimethylol propane or pentaerythritol, or an alicyclic polyol such as 1,4-cyclohexanedimethanol, may be used.

A resin having the above-mentioned polyester resin crosslinked with e.g. an oxycarboxylic acid type metal salt, may also be employed.

The binder resin to be used in the present invention preferably has a glass transition temperature of from 50 to 80° C. If the glass transition temperature exceeds 80° C., an excessive heat energy will be required at the time of thermal fixing, whereby a high speed fixing property tends to deteriorate. On the other hand, if the glass transition temperature is lower than 50° C., offset resistance at the time of fixing tends to be poor. Further, the number average molecular weight is preferably from 2,000 to 20,000. If the molecular weight is less than 2,000, releasability from a thermal fixing roller tends to be poor, whereby the offset phenomenon will be brought about. On the other hand, if it exceeds 20,000, the softening point will be high, and the thermal fixing powder tends to be low.

To prepare the toner of the present invention, it is preferred to employ a method wherein the above described toner-constituting materials are thoroughly mixed by a bowl mill or other mixing machine and then thoroughly kneaded by means of a heat kneader such as heat roll kneader or an extruder, and after cooling for solidification, subjected to mechanical pulverization and classification to obtain the toner. Otherwise, it is possible to employ a method wherein the constituting materials are dispersed in a binder resin solution, followed by spray drying; a polymerization method for production of a toner wherein the prescribed materials are mixed with a monomer for constituting the binder resin to obtain an emulsified suspension, followed by polymerization to obtain a toner; or a method wherein the prescribed materials are incorporated into a core material or a shell material, or into both of them, in so-called microcapsule toner comprising the core material and the shell material. Further, if necessary, the desired additives may thoroughly be mixed by a mixer such as a Henshel mixer, to prepare the toner of the present invention.

Now, the present invention will be described in further detail with reference to Examples. However, it should be understood that the present invention is by no means restricted to such specific Examples.

PREPARATION EXAMPLE 1

Preparation of the azo type iron complex of the above formula (C)

14.4 Parts by weight of 4-chloro-2-aminophenol was stirred together with 26 parts by weight of concentrated hydrochloric acid and 400 parts by weight of water, followed by cooling with ice to a temperature of from 0 to 5° C. Then, 6.9 parts by weight of sodium sulfite was added thereto, followed by stirring at the same temperature for two hours for diazotization. The diazotized product was poured into a mixed liquid comprising 300 parts by weight of water, 10 parts by weight of sodium hydroxide and 26.3 parts by weight of 3-hydroxy-2-naphthoanilide at a temperature of from 0 to 5° C. for a coupling reaction. Then, the monoazo compound was isolated. A paste of this monoazo compound was dispersed in 50 parts by weight of ethylene glycol and 150 parts by weight of water, and then 10 parts by weight of sodium hydroxide and 11 parts by weight of salicylic acid and sodium acetate were added thereto. While stirring the mixture, a 38% ferric chloride solution was dropwise added over a period of two hours while maintaining it at a temperature of from 25 to 30° C. Further, stirring was continued for 5 hours for metallizing. The precipitated product was collected by filtration to obtain an iron complex compound (sodium salt). The obtained paste was dispersed in 300 parts by weight of water, and 50 parts by weight of ethyl alcohol and 10 parts by weight of ammonium sulfate were added thereto. The mixture was stirred at a temperature of from 75 to 80° C. for 4 hours to carry out counter ion exchange. The obtained product was collected by filtration and washed with water and then dried under reduced pressure at from 50 to 60° C. to obtain 40 parts by weight of an ammonium iron complex of the above-mentioned formula (C) as the desired product of a blackish brown fine powder. The azo type iron complex of the above mentioned formula (C) thereby obtained, was pulverized by a jet mill and classified to obtain azo type iron complexes having volume average particle sizes of 2 μm, 10 μm and 20 μm.

The particle size distribution of the azo type iron complex having a volume average particle size of 10 μm was from 0.1 to 30 μm.

EXAMPLE 1

A case wherein the azo type iron complex of the above formula (C) having a volume average particle size of 10 μm. was used.

| | |
|---|---|
| Styrene-acryl type copolymer (TB-1000, tradename, manufactured by Sanyo Kasei K.K.) | 92 parts by weight |
| Carbon black (MA-100, tradename, manufactured by Mitsubishi Chemical Corporation) | 5 parts by weight |
| Wax (Biscol 550-P, tradename, manufactured by Sanyo Kasei K.K.) | 2 parts by weight |
| Compound of the formula (C) (one having a volume average particle size of 10 μm) | 1 part by weight |

With the above composition, the styrene-acryl type copolymer was melted by a heat kneader, and the entire composition was mixed and then cooled and roughly pulverized by a hammer mill and then finely pulverized by a jet mill. The obtained fine powder was classified by an air stream system precise classification apparatus to obtain a toner having a particle size of from 10 to 12 μm. The obtained toner was mixed with an iron powder carrier of about 200 mesh (DSP-128, manufactured by Dowa Teppun Kogyo K.K.) in a weight ratio of 2:50 (toner:iron powder carrier) to obtain a developer. Then, by a blow off apparatus, the initial specific charge and the specific charge after mixing for 3 hours, of this developer, were measured and found to be −21.5 μC/g and −25.3 μC/g, respectively.

COMPARATIVE EXAMPLE 1

A case wherein the azo type iron complex of the above formula (C) having a volume average particle size of 2 μm, was used.

| | |
|---|---|
| Styren-acryl type copolymer (TB-1000, manufactured by Sanyo Kasei K.K.) | 92 parts by weight |
| Carbon black (MA-100, tradename, manufactured by Mitsubishi Chemical Corporation) | 5 parts by weight |
| Wax (Biscol 550-P, tradename, manufactured by Sanyo Kasei K.K.) | 2 parts by weight |
| Compound of the formula (C) (one having a volume average particle size of 2 μm) | 1 part by weight |

A toner of from 10 to 12 μm was obtained in the same manner as in Example 1 except that the compound of the formula (C) was changed to one having a volume average particle size of 2 μm, by classifying by means of an air stream system precise classification apparatus. The obtained toner was mixed with an iron powder carrier of about 200 mesh (DSP-128, manufactured by Dowa Teppun Kogyo K.K.) in a weight ratio of 2:50 (toner:iron powder carrier) to obtain a developer. Then, by a blow off apparatus, the initial specific charge and the specific charge after mixing for 3 hours, of this developer, were measured and found to be −16.4 μC/g and −18.8 μC/g, respectively.

COMPARATIVE EXAMPLE 2

A case wherein the azo type iron complex of the above formula (C) having a volume average particle size of 20 μm, was used.

| | |
|---|---|
| Styrene-acryl type copolymer (TB-1000, manufactured by Sanyo Kasei K.K.) | 92 parts by weight |
| Carbon black (MA-100, tradename manufactured by Mitsubishi Chemical Corporation) | 5 parts by weight |
| Wax (Biscol 550-P, tradename, manufactured by Sanyo Kasei K.K.) | 2 parts by weight |
| Compound of the formula (C) (one having a volume average particle size of 20 μm) | 1 part by weight |

A toner of from 10 to 12 μm was obtained in the same manner as in Example 1 except that the compound of the formula (C) was changed to one having a volume average particle size of 20 μm, by classifying by means of an air stream system precise classification apparatus. The obtained toner was mixed with an iron powder carrier of about 200 mesh (DSP-128, manufactured by Dowa Teppun Kogyo K.K.) in a weight ratio of 2:50 (toner:iron powder carrier) to obtain a developer. Then, by a blow off apparatus, the initial specific charge and the specific charge after mixing for 3 hours, of this developer, were measured and found to be −10.5 μC/g and −16.7 μC/g, respectively.

The results of the initial specific charges and the specific charges after mixing for 3 hours, of the developers of Example 1 and Comparative Examples 1 and 2, are shown in Table 1.

TABLE 1

| | Specific charge (μC/g) | |
|---|---|---|
| | Initial value (3 min) | Value after mixing for 3 hours |
| Example 1 | −21.5 | −25.3 |
| Comparative Example | −16.4 | −18.8 |
| Comparative Example 2 | −10.5 | −16.7 |

As is evident from Table 1, the electrostatic image developing toner of the present invention comprising the azo type iron complex having a volume average particle size within a range of from 6 to 15 μm, can be instantaneously electrified to a proper level and has a performance such that the tribocharge performance will not deteriorate even when it was left to stand for a long period of time.

We claim:

1. An electrostatic image developing toner comprising an azo type iron complex having a volume average particle size within a range of from 6 to 15 μm and represented by the formula (A):

(A)

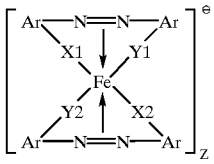

wherein Ar is an aryl group or a substituted aryl group, each of X1, X2, Y1 and Y2 is —S—, —O—, —CO—, —NH— or —NR— wherein R is a $C_{1-4}$ alkyl group, and Z is a cation as a counter ion.

2. An electrostatic image developing toner comprising an azo type iron complex having a volume average particle size within a range of from 6 to 15 μm and represented by the formula (B):

(B)

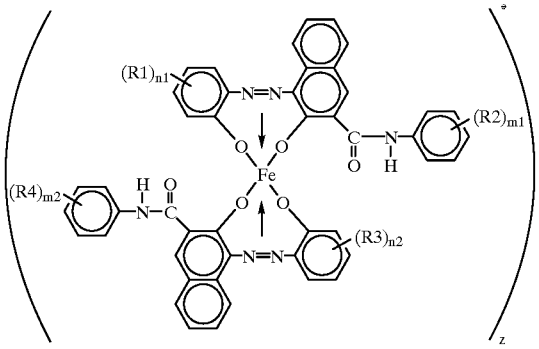

wherein each of R2 and R4 which may be the same or different from each other, is a hydrogen atom, a lower alkyl group, a lower alkoxy group, a nitro group or a halogen atom, each of m1 and m2 is an integer of from 1 to 5, each of R1 and R3 which may be the same or different from each other, is a hydrogen atom, a $C_{1-18}$ alkyl group, an alkenyl group, a sulfonamide group, a mesyl group, a sulfonic group, a carboxyl group, a carboxyester group, a hydroxyl group, a $C_{1-18}$ alkoxy group, an acetylamino group, a benzoylamino group, a nitro group or a halogen atom, each of n1 and n2 is an integer of from 1 to 4, and Z is a cation as a counter ion.

3. The electrostatic image developing toner according to claim 1, wherein the azo type iron complex has a volume average particle size within a range of from 8 to 13 μm.

4. The electrostatic image developing toner according to claim 2, wherein the azo type iron complex has a volume average particle size within a range of from 8 to 13 μm.

5. An electrostatic image developing toner comprising an azo type iron complex having a volume average particle size within a range of from 6 to 15 μm and represented by the formula (C):

(C)

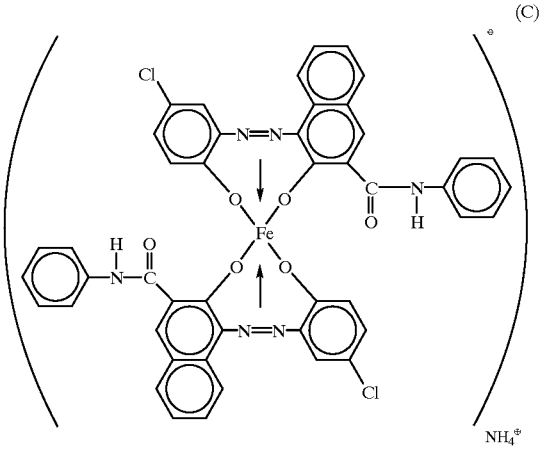

6. The electrostatic image developing toner according to claim 5, wherein the azo type iron complex has a volume average particle size within a range of from 8 to 13 μm.

* * * * *